US005945623A

United States Patent [19]

Goldstein et al.

[11] Patent Number: 5,945,623

[45] Date of Patent: Aug. 31, 1999

[54] HYBRID ELECTROTHERMAL GUN WITH SOFT MATERIAL FOR INHIBITING UNWANTED PLASMA FLOW AND GAPS FOR ESTABLISHING TRANSVERSE PLASMA DISCHARGE

[75] Inventors: Yeshayahu Shyke A. Goldstein, Gaithersburg, Md.; Melvin Widner, Rochester Hills, Mich.

[73] Assignee: General Dynamics Armament Systems, Inc., Burlington, Vt.

[21] Appl. No.: 08/329,755

[22] Filed: Oct. 26, 1994

[51] Int. Cl.[6] ..... F42B 5/08

[52] U.S. Cl. ..... 89/8; 102/202.8; 102/472

[58] Field of Search ..... 89/8; 102/202.7, 102/202.8, 430, 469, 470, 472

[56] References Cited

U.S. PATENT DOCUMENTS

| | | | |
|---|---|---|---|
| 161,514 | 3/1875 | Hunting | 102/469 |
| 307,071 | 10/1884 | Russell | 102/472 |
| 4,590,842 | 5/1986 | Goldstein et al. | 89/8 |
| 4,715,261 | 12/1987 | Goldstein et al. | 89/8 |
| 4,974,487 | 12/1990 | Goldstein et al. | 89/7 |
| 5,012,719 | 5/1991 | Goldstein et al. | 89/8 |
| 5,072,647 | 12/1991 | Goldstein et al. | 89/8 |
| 5,444,208 | 8/1995 | Mortensen | 89/8 |

OTHER PUBLICATIONS

Popular Science, "Tabletop Artillery", Aug. 1992, p. 26.

*Primary Examiner*—Stephen M. Johnson

*Attorney, Agent, or Firm*—Finnegan, Henderson, Farabow, Garrett & Dunner, L.L.P.

[57] ABSTRACT

A projectile accelerating pulsed gas source comprises a structure including a high voltage electrode for establishing axial electrical discharges in axial gaps behind an outlet where the projectile is located. Plasma flows at right angles to the discharges into a propellant that is converted into a high pressure component of the gas pulse. The gaps are arranged so that after the projectile moves away from its initial position, power applied to the plasma via gaps close to the outlet is greater than power applied to the plasma via gaps farther from the outlet. The gaps are arranged so power applied to the plasma is substantially the same in the discharges when plasma is initially produced. The gaps include walls that are eroded differently by the discharges so gap walls close to the outlet erode faster than gap walls farther from the outlet. The plasma has sufficient pressure so it tends to flow from a confining structure for it into contact with the electrode via a secondary flow path other than the flow path through the outlet. The confining structure includes a cavity in the secondary flow path. A soft, non-electrically conducting material in the cavity expands in a direction at right angles to the secondary flow path and compresses in the direction of the secondary flow path against walls of the cavity to form a seal to overcome the plasma tendency to flow into contact with the electrode.

42 Claims, 3 Drawing Sheets

HYBRID ELECTROTHERMAL GUN WITH SOFT MATERIAL FOR INHIBITING UNWANTED PLASMA FLOW AND GAPS FOR ESTABLISHING TRANSVERSE PLASMA DISCHARGE

FIELD OF INVENTION

The present invention relates generally to high pressure pulsed gas sources particularly adapted to be used in electrothermal guns and, more particularly, to a high pressure pulsed gas source including a structure for establishing at least several axial discharges for deriving a plasma which flows into a propellant mass. Another aspect of the invention relates to such a high pressure pulsed gas source including a high pressure plasma that traverses a first flow path to an outlet in response to electrical energy being applied to an electrode, wherein the plasma has sufficient pressure so it tends to flow via a second flow path through a confining structure to the electrode, which tendency is overcome by a soft non-electrically conducting material in a cavity of the confining structure, wherein the soft material expands radially and is compressed axially relative to the second flow path to the electrode.

BACKGROUND ART

High pressure pulsed gas sources derived by electrothermal techniques are disclosed, for example, in commonly assigned U.S. Pat. Nos. 4,590,842, 4,715,261, 4,974,487 and 5,012,719. In these prior art pulsed gas sources, a capillary discharge is formed in a passage between a pair of spaced electrodes at opposite ends of a dielectric tube, preferably formed of polyethylene. In response to a discharge voltage between the electrodes, a high pressure, high temperature plasma fills the passage, causing material to be ablated from the dielectric wall. High temperature, high pressure plasma gas flows longitudinally of the discharge and the passage through an aperture defined by an electrode at one end of the passage. The gas flowing longitudinally from the passage through the aperture produces a high pressure, high velocity gas jet that can accelerate a projectile to a high velocity. In the '487 patent, the high pressure, high temperature plasma interacts with a propellant mass to produce a high temperature propellant. In the '719 patent, hydrogen is produced by interacting the plasma flowing through the orifice with a metal hydride and some other material to produce high pressure hydrogen. The plasma is cooled by interacting with a cooling agent, for example water, while an exothermal chemical reaction is occurring.

In the '487 patent, the pressure acting on the rear of a projectile is maintained substantially constant while the projectile is accelerated through a barrel bore even though the volume of the barrel bore between the high pressure source outlet orifice and the projectile increases. Such a result is attained by increasing the electric power applied to the capillary discharge in a substantially linear manner as a function of time.

In still a further high pressure pulsed gas source disclosed in commonly assigned U.S. Pat. No. 5,072,647, a high pressure plasma discharge is established between a pair of axially displaced electrodes. The pressure of the plasma in the discharge is sufficient to accelerate a projectile in a gun barrel bore. The plasma is established in a walled structure confining the discharge and having openings through which the plasma flows transversely of the discharge. A chamber surrounding the wall includes a slurry of water and metal particles to produce high pressure hydrogen gas that flows longitudinally of the discharge against the rear of a projectile. To maintain the pressure of the hydrogen gas acting against the projectile relatively constant as the projectile is accelerated down the barrel, electric power applied to the discharge increases substantially linearly as a function of time.

Some concepts employed in the '647 patent have been incorporated into the copending, commonly assigned application Ser. No. 08/238,433, filed May 5, 1994. In this copending application, a structure establishes at least several axial electrical discharges across axial gaps behind an outlet of a high pressure pulsed gas source, particularly adapted for driving a projectile. The discharges cause plasma to flow with components at right angles to the axial discharges. A conventional propellant mass, e.g. gunpowder, or a hydrogen producing mass, as disclosed in the '647 patent, is positioned to be responsive to the plasma flow resulting from the discharges. In response to the plasma resulting from the discharges being incident on the propellant mass, a high pressure gas pulse is produced.

Those working in the art have recognized that it is desirable for plasma accelerating a projectile to have a maximum amount of energy close to the base, i.e., rear, of the projectile. Hence, after a projectile is initially accelerated, it is desirable for the power close to the projectile, at the front of a plasma source, to be greater than the power at the rear of the plasma source. However, a problem in producing a plasma with such a power or energy distribution is that pressure waves have a tendency to be produced in the plasma source. The pressure waves from a high pressure plasma source, such as derived from a highly energetic electric power supply (having millions of Joules of energy), can be destructive of a projectile launcher including such a high pressure source. It is, therefore, desirable for a high pressure plasma source having at least several axial electrical discharges to initially produce plasma having about the same power over all of the gaps. After the projectile has moved away from its initial position, it is then desirable for the power applied to the plasma close to the projectile to exceed the power of the plasma farther from the projectile.

A problem with the aforementioned types of devices is that the plasma has as tendency to flow through a plasma confining structure to an electrode needed to establish the axial electrical discharges; the electrode must be at a high voltage relative to metal parts close to it. If the plasma has a high temperature at the time it is incident on the electrode, many charge carriers are incident on the electrode, causing a low impedance electric path to subsist between the electrode and the metal parts. The electric discharges thus have a tendency to be quenched. To overcome this problem in the past, it has been the general practice to design the structure so the electrode is a great distance from the discharge structure. Such an arrangement enables the high temperature of the plasma to be largely dissipated to reduce the number of plasma charge carriers incident on the electrode. However, such a lengthy structure is not conducive to optimum design of cartridges including projectiles adapted to be loaded into military hardware.

It is, accordingly, an object of the present invention to provide a new and improved electrothermal apparatus for deriving a high pressure gas pulse, particularly adapted to drive a projectile in a gun bore.

Another object of the invention is to provide a new and improved cartridge including a projectile and an electrothermal structure for driving the projectile to high speeds in a gun barrel.

An additional object of the invention is to provide a new and improved electrothermal apparatus including at least several axially displaced gaps for deriving a plasma that flows radially with respect to a structure including the axial gaps.

A further object of the invention is to provide a new and improved cartridge including a projectile attached to a structure for deriving at least several axially spaced plasma jets that flow into a propellant mass that is radially displaced from the structure.

An added object of the invention is to provide a new and improved high pressure pulsed gas source, particularly adapted for accelerating a projectile along a gun barrel, and including at least several axial gaps for providing at least several axial electrical discharges behind an outlet of the source to apply greater power to the plasma via gaps close to the outlet than the power applied to the plasma via the gaps farther from the outlet, after the pulse is initially formed and is still being derived.

Another object of the invention is to provide a new and improved high pressure pulsed gas source particularly adapted for accelerating a projectile along a gun barrel, including a structure for establishing at least several axial discharges in axial gaps behind an outlet of the source where the projectile is initially located, wherein the plasma, as initially produced, has substantially the same pressure in all of the gaps and produces sufficient pressure to accelerate the projectile away from the initial position thereof and after the projectile moves away from its initial position and is in the barrel, the power applied to plasma in gaps close to the projectile is greater than the power applied to plasma in gaps farther from the projectile.

A further object of the invention is to provide a new and improved cartridge including a projectile and a propelling structure for the projectile, wherein the propelling structure establishes at least several axial electrical discharges in corresponding axial gaps, which discharges result in a high pressure gas pulse that applies a greater amount of plasma to a projectile traversing a barrel via gaps close to the projectile than is applied via gaps farther from the projectile.

An additional object of the invention is to provide a new and improved cartridge including a projectile and a structure for establishing at least several axial electrical discharges in axial gaps behind the projectile, wherein plasma resulting from the discharges is incident on a propellant mass and the axial gaps are arranged so that (a) when the plasma is initially produced the power applied to the plasma is substantially the same over the several discharges and has sufficient pressure to accelerate the projectile away from an initial position thereof, without destroying the structural integrity of the projectile launcher, and (b) after the projectile has moved away from its initial position the power applied to the plasma via gaps close to the projectile is greater than the power applied to the plasma via gaps farther from the outlet.

It is a further object of the invention to provide a new and improved structure for overcoming the tendency for high temperature plasma to be coupled from an electrical discharge structure via a plasma containment structure to an electrode designed to be maintained at a voltage quite different from that of the discharge structure.

Still an additional object of the invention is to provide a new and improved relatively short structure for overcoming the tendency for high temperature plasma to be coupled from a plasma generating electrical discharge structure, wherein the plasma is prevented from reaching an electrode for establishing the discharge.

The Invention

In accordance with one aspect of the invention, a high pressure pulsed gas source, particularly adapted to accelerate a projectile along a gun barrel, comprises a structure for establishing at least several axial electrical discharges in corresponding axial gaps behind an outlet; the projectile is initially located immediately in front of the outlet. The discharges cause plasma to flow with components at right angles to the axial discharges for a substantial time while the pulse is being derived and while the projectile is traversing the barrel. A propellant mass positioned to be responsive to the plasma flow resulting from the discharges is converted into a high pressure component of the gas pulse by the plasma. The axial gaps are arranged so that after the pulse is initially formed and is still being derived, i.e., after the projectile moves away from its initial position and is in the barrel, the power applied to the plasma via gaps close to the outlet is greater than the power applied to the plasma via the gaps farther from the outlet. Thereby, greater power and pressure are applied to the base of the projectile, to accelerate the projectile more efficiently and to higher velocities.

To avoid damage or destruction to a structure for deriving the high pressure gas pulse, e.g., the gun including the barrel, the axial gaps are arranged so that when the plasma is initially produced and the pulse is initially derived, the power applied to the plasma is substantially the same in the several discharges.

Preferably, the gaps include walls that erode differently in response to the discharges so that during the application of power to the gaps the walls of the gaps close to the outlet and projectile erode faster than the walls of the gaps farther from the outlet and projectile. Initially, the power developed in all of the gaps is approximately the same. After a particular discharge structure has been used once, it is discarded, as is common for the accelerating portions of projectile cartridges.

In one embodiment, the walls of the gaps close to the projectile have a smaller radius than walls of the gaps farther from the projectile, to cause greater erosion of the gaps close to the projectile than the walls of the gaps farther from the projectile. A similar result is achieved by arranging the walls of the gaps close to the projectile to be axially closer to each other than the walls of the gaps farther from the projectile. Greater uniformity of the initial application of power to the gaps is provided by combining the two aforementioned factors, i.e., by arranging the walls of the gaps close to the projectile to have a smaller radius than the walls of the gaps farther from the projectile and arranging the walls of the gaps close to the projectile to be closer to each other than the walls of the gaps farther from the projectile. The gap length and wall radii can be changed gradually from gap to gap or half of the gaps close to the outlet can have the same first configuration while the gaps remote from the outlet can have a second configuration which differs from that of the first configuration.

In another embodiment, the walls of the gaps close to the projectile are formed of a material different from the material in walls of the gaps farther from the projectile; preferably the gaps close to the projectile have lower melting temperature walls than walls of the gaps farther from the projectile.

The use of gaps having different geometries and walls with different materials is predicated on the proposition that during a discharge all of the gap lengths increase. The increase in length of the smaller gaps is greater than the increase in length of the larger gaps. Thus, there is a shift in the plasma power toward the front of the plasma source where the small gaps are located. In a similar manner, as the radial length of the gap walls increases, the resistance of the plasma in the gap decreases, resulting in lower power dissipation in the gap for equal length gaps. The decreased power dissipation in the gaps having the longer walls results in less erosion from these walls and thereby causes less erosion of the longer walls farther from the projectile than the shorter walls closer to the projectile.

Preferably, each wall is part of a member having an outer periphery beyond the wall. The outer periphery is formed of a non-electrically conducting material that is eroded by the plasma at a rate which is slower than the wall material. The outer periphery thus retains its geometry during the discharge so plasma incident on the outer surface thereof does not change the discharge structure. This feature also provides predictable plasma flow characteristics from the discharge structure into the propellant.

According to a further aspect of the invention, the electrical power supply connected to the structure enables the pressure applied to the projectile to remain approximately constant while the projectile is being accelerated in the barrel, even though the volume in the barrel between the outlet of the high pressure source and the base of the projectile is increasing. To these ends, the power supply initially produces a high power electric pulse to initially apply a high pressure plasma from the several discharges to the projectile. Then, after the projectile has moved away from its initial position, a smaller amount of electric power is applied to the gaps. At this time the stored potential energy in the propellant mass is converted into pressure that is applied to the projectile via the barrel. Electric power applied to the gaps is then ramped upwardly to increase the plasma pressure and the pressure resulting from the converted propellant mass, such that the total pressure applied to the projectile remains approximately constant from a moment shortly after the discharge is initially generated to the end of the discharge, typically about 1,000 microseconds after the initial discharge occurs.

In accordance with a further aspect of the invention, a source for deriving a high pressure gas pulse in an outlet comprises an electric discharge device for establishing a high pressure plasma with sufficient energy to accelerate a projectile in a barrel. The discharge device includes an electrode that is designed to be at a high voltage relative to metal parts close to it. The high pressure plasma flows via a flow path from the discharge device to an outlet to accelerate the projectile axially along the gun barrel. The plasma has sufficient pressure so it tends to flow out of a confining structure for it into contact with the electrode via another flow path. The confining structure includes a cavity located in the another flow path. A soft, non-electrically conducting material located in the cavity expands in a direction at right angles to the another flow path and compresses in the direction of the another flow path against walls of the cavity to form a seal for overcoming the tendency of the plasma to flow out of the confining structure into contact with the electrode. Such an arrangement enables a gap structure of the electric discharge device where the plasma is formed to be close to the electrode and prevents high temperature, high conductivity plasma from flowing to the electrode. Thereby, a high voltage in the gap structure is maintained throughout the time a power supply is supplying high voltage between the electrode and the gap structure.

In a preferred embodiment, the chamber is formed as a pocket having a first, tapered wall and a second axially extending wall. The first and second walls intersect to form a closed end of the pocket, which has an open end that is closer to the gap structure than the closed end. The soft material, initially in contact with the first and second walls, expands radially and is compressed axially toward the closed end of the pocket against these walls. Such a structure has been found particularly advantageous in a device including several axial discharge gaps, wherein it has been found that the plasma has a tendency to flow axially in a direction opposite from the flow direction of the propellant gas into the bore and against the projectile base.

The above and still further objects, features and advantages of the present invention will become apparent upon consideration of the following detailed description of several specific embodiments thereof, especially when taken in conjunction with the accompanying drawings.

DESCRIPTION OF THE PREFERRED EMBODIMENTS

Figure 1:
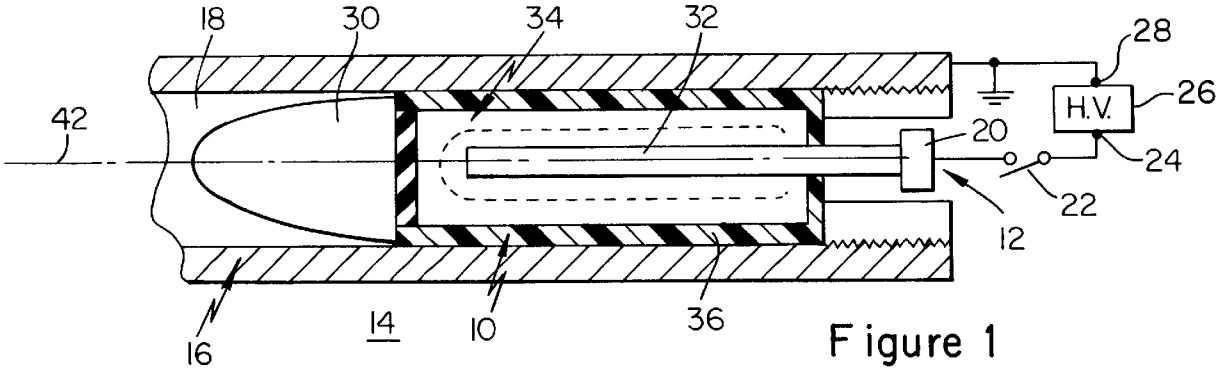
FIG. 1 is a side sectional view of a cartridge incorporating the present invention, as loaded in a gun barrel.

Reference is now made to FIG. 1, wherein cartridge 10 is illustrated as being loaded in breech 12 of gun 14 including metal barrel 16 surrounding cylindrical bore 18. When cartridge 10 is in place, high voltage electrode 20 of the cartridge is selectively connected via switch contacts 22 to high voltage terminal 24 of highly energetic DC pulse power supply 26, having a grounded power supply terminal 28 connected to the exterior metal wall constituting barrel 16. Typically, power supply 26 produces sufficient energy to accelerate projectile 30 of cartridge 10 in and through bore 18. Power supply 26 causes cartridge 10 to produce a high pressure plasma pulse which is coupled to propellant mass 34. The propellant mass releases chemical energy which produces a pressure pulse that is combined with the plasma pressure to drive projectile 30. A typical energy level of supply 26 is on the order of 100 kiloJoules and the peak voltage of the supply is in the 4 to 20 kilovolt range.

Cartridge 10, in addition to including projectile 30, includes discharge structure 32 for generating the high pressure, highly energetic plasma in response to switch 22 being closed. The discharge structure is surrounded by propellant mass 34, typically a conventional explosive mixture, e.g. gunpowder, that reacts chemically in response to the high pressure, high temperature plasma applied to it by structure 32. Alternatively, propellant mass 34 can include chemical reactants to produce helium, hydrogen or other light gases in response to the high pressure plasma produced by structure 32. Propellant mass 34 is converted into a high pressure, relatively low temperature gas by the plasma derived by structure 32 and substantially reduces the plasma temperature so barrel 16 is not damaged.

In response to the high pressure plasma initially derived from structure 32, projectile 30, initially fixedly attached to frangible end face 104 of cartridge housing 36, is accelerated away from structure 32. When end face 104 is broken by the pressure from the plasma an outlet is provided for the high pressure gas pulse derived from the chemical and electrical sources. Projectile 30 is thereafter propelled down bore 18 of barrel 16.

Figure 2:
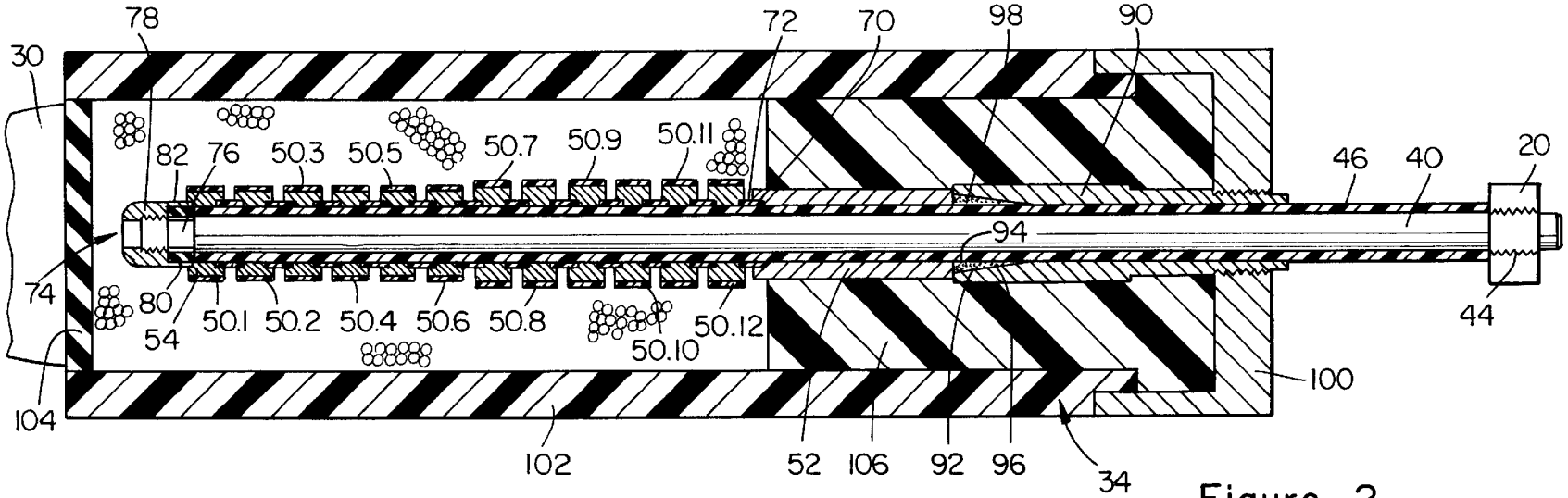
FIG. 2 is a side sectional view of a preferred embodiment of the cartridge illustrated in FIG. 1.

As illustrated in FIG. 2, cartridge 10 includes axially extending metal rod 40 that is coaxial with longitudinal axis 42 of barrel bore 18. One end of metal rod 40 extends rearwardly of back metal end wall 100 of cartridge case 36 and includes threads 44 on which cylindrical metal electrode 20 is screwed, for the selective application of high voltage from terminal 24 of high voltage supply 26. Metal rod 40 is surrounded by electrical insulating tube 46 for virtually its entire length, between electrode 20 and the end of the metal rod proximate projectile 30. The outer diameter of rod 40 is suitably bonded, for example, by glue, to the inner diameter of tube 46.

A structure for deriving at least several, e.g., 13, axial discharges in the direction of axis 42 includes axially displaced rings 50.1–50.12 and metal sleeve 52, all of which are coaxial with, bonded to and surround insulating tube 46. (When all of rings 50.1–50.12 are referred to in a general manner, or collectively, they are referred to herein as rings 50 or each of rings 50.) As illustrated in detail in FIG. 3, each of rings 50 includes a metal interior portion 54 having an outer circular wall (in cross-section) bonded to the interior cylindrical wall of electrically insulating annular outer portion 56. The metal portion 54 of each of rings 50 includes a radially extending wall 58 that is aligned with a corresponding radially extending wall 60 of annular portion 56. Annular portion 56 is made of a material (e.g. KAPTON or LEXAN) that erodes at a much slower rate than metal wall 58 in response to an electric discharge established in gap 62 between adjacent, facing metal walls 58 of adjacent rings 50. To minimize the initial power supply requirements of high voltage source 26, fusible metal wire 64 extends between and is connected to the facing walls of metal portions 54 of adjacent rings 50. Wire 64 ruptures in response to the initial application of power by supply 26 to electrode 20 in response to closure of switch 22.

Each of rings 50 includes axially extending notch 66 along its interior circumferential wall. Each of notches 66 extends from wall portion 58 toward the axial center of each of rings 50 through a distance in excess of the erosion of wall 58 during application of electric energy from power supply 26 to electrode 20. The space between facing walls of notches 66 of a pair of adjacent rings 50 is filled by axially extending electrically insulating washers 68 having axial end and circumferential walls that bear against the end and circumferential walls of notches 66, to hold rings 50 in place, while maintaining discharge gap 62. A similar notch 70 is provided in the end of sleeve 52 adjacent ring 50.12 and is filled by electrically insulating washer 72, to provide a gap between ring 50.12 and sleeve 52 that is basically the same as the discharge gap between adjacent, facing walls 58 of rings 50.11 and 50.12.

The entire assembly of rings 50 and washers 68, as well as washer 72, is held in place by assembly 74 at the end of metal rod 40 proximal projectile 30. Assembly 74 also provides an electrical path from metal rod 40 to the metal portion 54 of ring 50.1 and a further axial discharge gap to ring 50.2. To these ends, the end of metal rod 40 proximal projectile 30 is threaded to metal thimble 78, having a shoulder which bears on electrically insulating washer 80. The shoulder of thimble 78 also bears against an end face of electrical insulating tube 82 that is identical to washers 68 and concentric with and bonded to washer 80. The other end face of tube 82 fits into notch 66 at the forward end of ring 50.1 against an end face of tube 46. One end of washer 80 abuts the end face of tube 46. Thimble 78 is turned sufficiently so pressure is exerted by the shoulder of the thimble on tube 82, thence on the wall of notch 66 of ring 50.1 that is proximal projectile 30, to drive all of the notches of rings 50 into engagement with the corresponding surfaces of electrically insulating washers 68, to press washer 72 against the wall of notch 70 in sleeve 52. Since sleeve 52 is glued to metal rod 40, the entire assembly of rings 50 and washers 68 is held in place.

To complete the electric path for the current flowing through the axial gaps 62 between wall portions 58 of rings 50, the end wall of sleeve 52 remote from the rings abuts against and is bonded to an abutting end wall of metal sleeve 90, having an interior cylindrical wall adhesively bonded to the exterior wall of insulating tube 46. The end of sleeve 90 abutting sleeve 52 includes chamber 92 formed as a pocket having axially extending wall 94 and tapered wall 96. Hence, pocket chamber 92 has an open end at the intersection of the end faces of sleeves 52 and 90 and a closed end at the intersection of walls 94 and 96. Wall 96 is tapered from the end of sleeve 90 closest to sleeve 52 toward electrode 20, at the end of metal rod 40. Chamber 92 is filled with a soft, non-electrically conductive solid mass 98, such as petroleum jelly. (A soft material is defined as a material having a Poisson ratio of approximately 1, such that a unit change in length of the material is approximately equal to a unit change in width of the material in response to a force that is applied to the material in the direction of the length of the material; a soft material acts like a water bag when it is compressed.)

Plasma produced in discharge gaps 62 generally flows radially outward into propellant mass 34 that surrounds the discharge structure. However, some of the plasma has a tendency to flow axially of the discharge structure and axis 42 toward electrode 20. If electrode 20 is sufficiently close to the plasma flowing from the discharge toward it and chamber 92 and mass 98 were not included, a relatively low electric impedance path would be provided from electrode 20 to grounded metal sleeves 52 and 90, which are part of the return path for the current flowing from the high voltage terminal of power supply 26 to barrel 16. If such a low impedance path extends from electrode 20 to barrel 16, the amount of energy supplied to the discharge gaps between rings 50 is insufficient to provide proper operation of the high pressure gas source which accelerates projectile 30 in bore 18. In the prior art, generally such short circuits were prevented by making the cartridge sufficiently long so plasma incident on the high voltage electrode was relatively cool, having few energetic charge carriers to establish a high impedance path from the electrode to the grounded gun barrel. A disadvantage of such an approach, however, is the relatively long cartridge length.

The soft, electrically insulating mass 98 loaded into chamber pocket 92 enables cartridge 10 to be relatively short. Chamber 92 and mass 98 are in the flow path of the plasma from rings 50 to electrode 20, along the abutting circumferences of tube 46 and sleeve 90. In response to the high pressure of the plasma (e.g. several kilobars), the soft material (1) compresses axially toward the rear of chamber 92, where walls 94 and 96 meet, and (2) expands radially against walls 94 and 96. Thereby, a high electrical impedance seal is provided in the plasma flow path which tends to exist from rings 50 to electrode 20 via the "abutting end" surfaces of tube 46 and sleeve 90.

To complete the electric discharge path for the current to the negative terminal of power supply 26, cartridge casing 34 includes steel stub case 100 that is threaded to the end of metal sleeve 90. The outer cylindrical wall of stub case 100 abuts the interior cylindrical wall of metal barrel 16 to complete the circuit for high voltage supply 26 when switch 22 is closed.

The remainder of casing 34 is formed of electrically insulating tube 102 having electrically insulating, frangible end wall 104. The exterior cylindrical wall of tube 102 abuts the interior wall of barrel 16 and, in this abutting position, has sufficient thickness to withstand the pressure produced by the plasma discharges established in gaps 62 and the pressure produced by propellant mass 34 which surrounds and is in front of the discharge structure. Frangible end wall 104, to which projectile 30 is attached, is ruptured by the high pressure produced in propellant mass 34 in response to ignition of the propellant mass by the high pressure plasma derived from the discharges in gaps 62. The region behind propellant mass 34 to the end wall of stub case 100 is filled by plastic, electrically insulating, solid filler 106.

Propellant mass 34 is packed into the region of cartridge 10 from end wall 104 to a region slightly behind gap 62 between ring 50.12 and sleeve 52 to provide a flow path for the plasma established in gaps 62 against the rear end wall, i.e., base, of projectile 30. After the discharge plasma between gaps 62 is established the plasma flows radially from the gaps, transverse to the discharges in gaps 62. Then the plasma flows through mass 34, generally parallel to axis 42, causing end wall 104 to rupture and accelerate projectile 30. The high temperature, high pressure plasma interacts with propellant mass 34 to ignite the propellant and provide another high pressure gas component that flows generally parallel to axis 42 against projectile 30. The gas components from the plasma and the ignited propellant mass combine to drive projectile 30 down barrel 16 at high speed.

To maximize efficiency in transferring power from the pulsed pressure source including the axial discharges in gaps 62 and the pressure produced by the chemical reaction of propellant mass 34, it is desirable to provide a very high pressure close to the base of projectile 30 while the projectile is in the barrel a substantial distance from its initial position. In accordance with one aspect of this invention, such a high pressure is achieved by applying a significantly greater amount of power to gaps 62 of discharge structure 32 that are close to the projectile than is applied to the gaps that are farther away from the projectile, after projectile 10 has moved substantially from its initial position and is traversing barrel 16. For example, greater power is developed in "front" gaps 62 between rings 50.1–50.7 than is applied to "rear" gaps 62 between rings 50.7–50.12 and between ring 50.12 and the facing wall of sleeve 52, after projectile 10 has moved substantially from its initial position and is traversing barrel 16. However, if there is substantially more power in the front gaps 62 between rings 50.1–50.7 than in the remaining gaps when there is a small volume behind projectile 30 (at the time the projectile is initially accelerated and for several microseconds thereafter), substantial differential pressure waves are produced in this small volume. The substantial differential pressure waves can be of such magnitude as to have deleterious effects or be destructive of the high pressure gas containment structure in gun 14.

To resolve this problem, approximately the same power is initially applied to each gap 62 between rings 50.1–50.12 and the gap between ring 50.12 and sleeve 52. Gaps 62 are arranged so they have differential erosion properties as a function of time during the discharges in the gaps. The erosion properties are such that a greater amount of power is dissipated in the front gaps than is dissipated in the rear gaps after projectile 30 has moved sufficiently down barrel 16 so the differential pressure waves do not have an adverse effect on the barrel gas pressure confining structure. Because the differential pressure is distributed over a relatively large area of the interior walls of bore 16, the deleterious or destructive effects on the confining structure do not occur.

Figure 3:
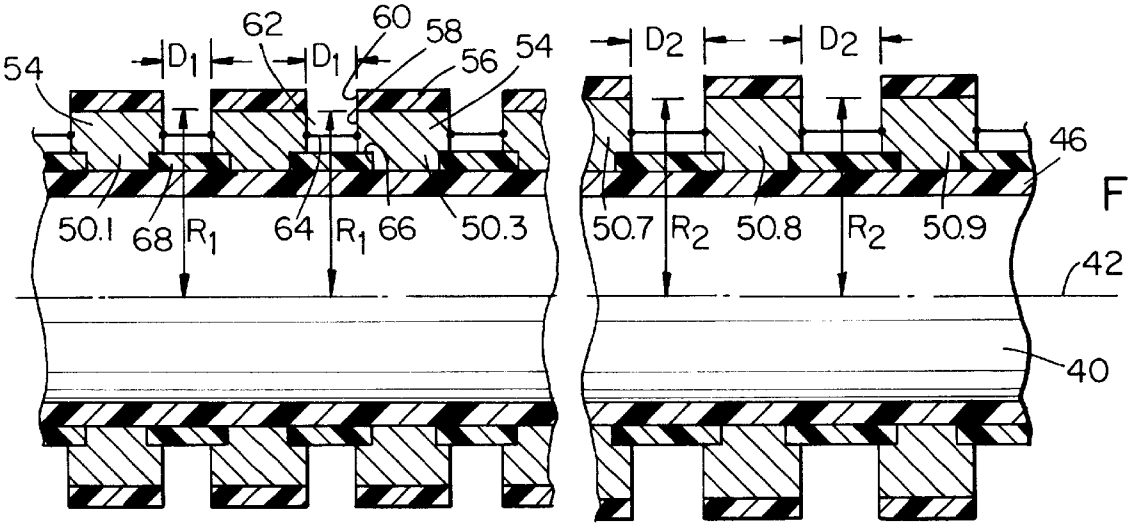
FIG. 3 a detailed view of a portion of the cartridge illustrated in FIG. 2.

In one embodiment of the invention, as illustrated in FIG. 3, the differential erosion effect is provided by forming the metal portions 54 of each of rings 50 of the same material, for example, copper or aluminum, and by providing the walls of the metal portion of the forward gaps with a geometry different from the walls of the metal portion of the rear gaps. The geometries are such that initially (immediately after rupture of fuse wires 64) the electrical resistance in each gap 62 is approximately the same, which causes approximately equal power dissipation in each gap. As time progresses during a discharge there are greater erosion and power dissipation in the forward gaps 62 between rings 50.1–50.6 than in the rear gaps between rings 50.6–50.12 and in the gap between ring 50.12 and sleeve 52. The lengths of the forward gaps 62 in the embodiment of FIG. 3 between rings 50.1–50.6 are less than the lengths of the rear gaps, between rings 50.6 and 50.12, as well as the gap between ring 50.12 and sleeve 52. In addition, the metal areas of the walls of the short forward gaps are less than the metal areas of the walls of the longer rear gaps, a result provided by forming the radii of the metal portions of the gaps formed by metal rings 50.1–50.6 so they are smaller than the radii of the metal portions 54 of rings 50.7–50.12 and the radius of sleeve 52 where it confronts the metal portion of ring 50.12. With the stated geometry, the initial resistance in each of gaps 62 is approximately the same, so the power dissipation in each of the gaps is also about the same at the beginning of a discharge. As time progresses during a discharge there is greater erosion from walls 58 of metal portions 54 of forward gaps 62 between rings 50.1–50.6 than in the rear gaps between the walls of the metal portions of rings 50.7–50.12. This is because there is much greater erosion of the metal in the forward gaps than in the rear gaps. The resistance, power dissipation and erosion rate of the small radius, narrow forward gaps are much less than in the large radius rear gaps because (1) the squared relationship between diameter and surface area causes the resistance of the forward gaps to be the square of the resistance of the rear gaps, which in turn causes the power dissipation in the forward gaps to be the fourth power of the rear gaps and (2) greater energy is dissipated in a narrow gap than a long gap. Hence, as time progresses during a discharge, greater power is applied to the portion of propellant mass 34 closest to projectile 30 than is applied to the propellant mass segment farther away from the projectile.

While, in the preferred embodiment, it is desirable for the gap length and gap radius to increase in a like manner, it is to be understood that it is also possible to achieve somewhat similar results by maintaining one of gap length or gap radius constant, while varying the other parameter. However, it is somewhat difficult, in these alternative instances, to provide uniform initial power dissipation in all of the gaps along the length of the discharge.

Figure 4:
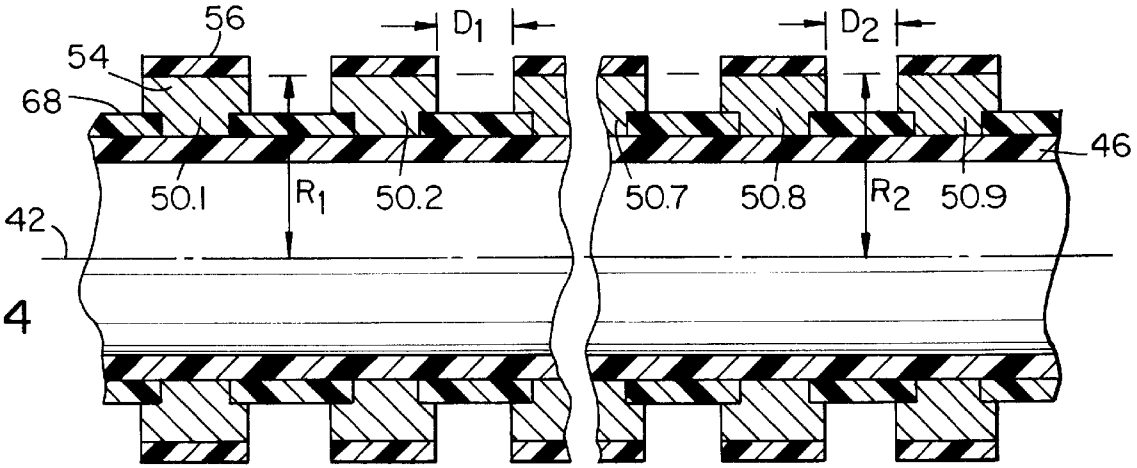
FIG. 4 is an alternate embodiment of the apparatus illustrated in FIGS. 2 and 3 wherein walls forming the gaps have the same length and the gap distance is the same, but wherein walls of different gaps are made of different materials.

In another embodiment, illustrated in FIG. 4, all of the gaps have the same length and radius. In the embodiment of FIG. 4, differential erosion of the forward and rear gaps as a function of time and equal initial power dissipation in all of the gaps are attained by forming metal portions 54 of forward rings 50.1–50.6 of a different material from metal portion 54 of rings 50.7–50.12. The metal portions 54 of rings 50.1–50.6 are formed of a metal having a low vapor temperature relative to the vapor temperature of the metal forming portions 54 of rings 50.7–50.12. Thereby, there is greater erosion from the walls of the forward gaps, defined by the walls of metal portions 54 of rings 50.1–50.6, than from the walls of the rear gaps defined by the walls of metal portions 54 of rings 50.7–50.12.

In one preferred embodiment, rings 50.1–50.6 are formed of aluminum, while rings 50.7–50.12 and sleeve 52 are formed of copper. Since aluminum has a vapor temperature of 2467° C., while copper has a vapor temperature of 2595° C., it is apparent that a considerably greater amount of aluminum is eroded from the walls of the gaps between rings 50.1–50.6 in the embodiment of FIG. 4 than copper is eroded from the walls of the gaps between rings 50.6 and 50.12 during the approximately 1000 microsecond interval of the pulse waveform applied by power supply 26 to the electrode structure while switch 22 is closed.

Figure 5:
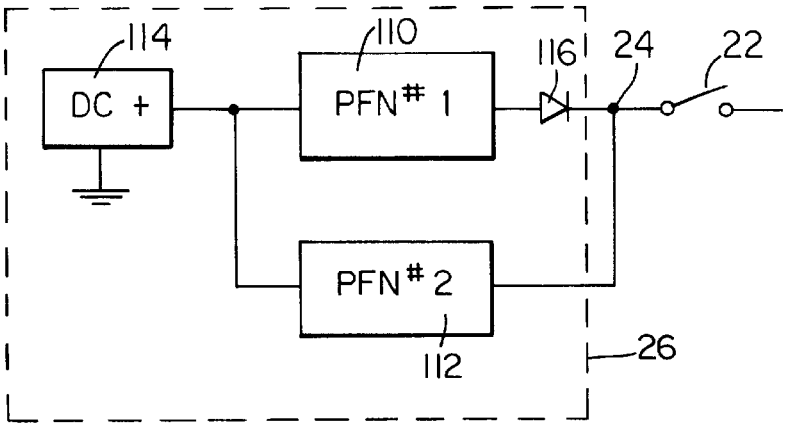
FIG. 5 is a block diagram of a power supply for energizing the cartridge of FIGS. 1–3.
Figure 6A:
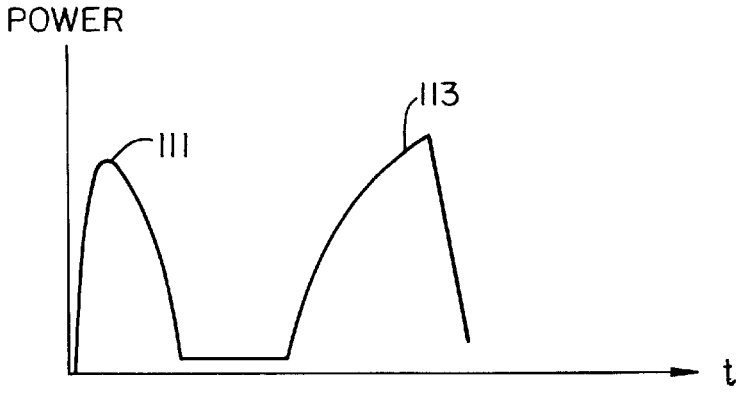
FIGS. 6A and 6B are electrical and pressure waveforms resulting from the power supply of FIG. 5.

A preferred embodiment of high voltage pulse power supply 26 is illustrated in FIG. 5 as including high voltage, high power pulse forming networks 110 and 112, which are precharged by high voltage DC power supply 114. FIG. 6A is a waveform of the power at terminal 24 for an interval beginning with closure of contacts 22 until approximately 1025 microseconds after the closure. Pulse forming network 110 is connected to output terminal 24 of high voltage pulse supply 26 via power diode structure 116, while the output terminals of pulse forming network 112 are directly connected to terminal 24. Pulse forming network 110 initially produces a high voltage pulse wave segment 111 (FIG. 6A) having an initial steep slope followed by a rounded portion and a fairly steep trailing edge, in the nature of a half wave rectified sinusoid. In contrast, pulse forming network 112 produces a ramping, approximately linear power output wave segment 113 that drops quickly to zero after reaching a maximum value.

Pulse forming networks 110 and 112 are constructed so that in response to switch 22 being closed, the half wave rectified sinusoidal-like power variation 111 at the output of pulse forming network 110 is applied to terminal 24. After approximately 300 microseconds, the power at the output of pulse forming network 110 drops close to zero; the power at terminal 24 is also close to zero during this interval and for about the next 200 microseconds. Approximately 500 microseconds after switch contacts 22 have been closed, the upward ramping portion 113 of pulse forming network 112 begins. The ramp portion 113 reaches a peak value approximately 1000 microseconds after the closure of switch 22. Pulse forming network 112 is constructed so there is a sharp decrease in the output power thereof after the maximum output power is achieved. Diode structure 116 prevents the high power output of pulse forming network 112 from being coupled into the output terminals of pulse forming network 110, which are at a low voltage level while the ramp is derived from pulse forming network 112.

Figure 6B:
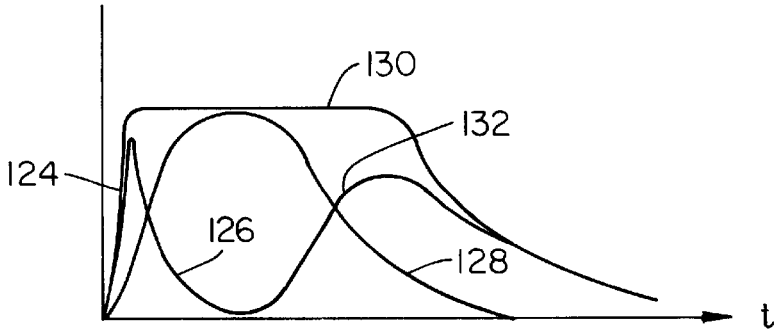

The steep leading edge of wave segment 111 at the output of pulse forming network 110 ruptures wires 64 in gaps 62 and then causes high pressure plasma pulses to be produced in the gaps between rings 50, as well as in the gap between ring 50.12 and sleeve 52. This plasma is rapidly produced, as indicated by waveform segment 124, FIG. 6B, wherein pressure at the base of projectile 30 is plotted as a function of time. The high pressure plasma in gaps 62 between rings 50 resulting from the output power of pulse forming network 110, however, has a tendency to decrease rather rapidly and then trails off at a slower rate, as indicated by waveform segment 126. The chemical propellant in mass 34 is ignited by the high temperature, high pressure plasma flowing radially from gaps 62. The ignited propellant in mass 34 exerts a pressure component, indicated by waveform 128, against the base of projectile 30. The maximum pressure of waveform 128 is equal approximately to the maximum pressure of waveform 124. The maximum pressure of waveform 128 occurs about 100 microseconds after the maximum pressure of waveform 124. The pressures of waveforms 124 and 128 combine to produce a relatively constant pressure against the base of projectile 30, indicated by waveform 130, for approximately 500 microseconds after the closure of contacts 22. At approximately 500 microseconds, the pressure resulting from ignition of propellant mass 34 has decreased substantially from its maximum value.

To maintain the pressure applied to the base of projectile 30 constant for the entire approximately 1000 microsecond interval while the projectile is in bore 18, pulse forming network 112 increases the plasma pressure in a substantially linear manner, as indicated by waveform segment 132, and reduces the falloff from ignition of chemical propellant mass 34. The linear plasma pressure increase overcomes the decreasing effects of the pressure of the plasma resulting from energization thereof by pulseforming network 110 and the decrease in pressure resulting from ignition of chemical propellant mass 34 by the plasma resulting from the output of pulse form network 110. In addition, the increased plasma in gaps 62 resulting from the ramp portion 113 of the output of pulse forming network 112 ignites additional material in chemical propellant mass 34. The cumulative effects are such that the combined pressure on the base of projectile 30 remains relatively constant, despite the increasing volume in bore 18 between the outlet of cartridge 10 and the base of the projectile as it traverses barrel 16. Pulse forming network 112 produces ramping power and pressure variations, rather than step-like power and pressure variations to prevent an over-pressure in barrel 16 that could have detrimental and possibly destructive effects on gun 14.

While there have been described and illustrated specific embodiments of the invention, it will be clear that variations in the details of the embodiments specifically illustrated and described may be made without departing from the true spirit and scope of the invention as defined in the appended claims.

We claim:

1. Apparatus for accelerating a projectile along a gun barrel having a longitudinal axis comprising a structure for establishing at least several axial gaps for providing at least several axial electrical discharges behind the projectile, the discharges causing plasma to flow with components at right angles to the axial discharges for a substantial time while the projectile is traversing the barrel, a propellant mass positioned to be responsive to the plasma flow resulting from the discharges, the propellant mass being converted into a high pressure gas for accelerating the projectile in the barrel in response to the plasma resulting from the discharges being incident on the propellant mass, the axial gaps being arranged so that after the projectile moves away from its initial position and is in the barrel the power applied to the plasma via gaps close to the projectile is greater than the power applied to the plasma via the gaps farther from the projectile.

2. The apparatus of claim 1 wherein the axial gaps are arranged so that when the plasma is initially produced the power applied to the plasma is substantially the same over the at least several discharges and results in sufficient pressure to accelerate the projectile away from an initial position thereof.

3. The apparatus of claim 1 wherein the axial gaps are arranged so that when the plasma is initially produced the power applied to the plasma is such that pressure waves in the propellant resulting from the plasma are not destructive of structural parts of the accelerating apparatus.

4. The apparatus of claim 1 wherein the gaps include walls that erode differently in response to the discharges so that the walls of the gaps close to the projectile erode faster than the walls of the gaps farther from the projectile.

5. The apparatus of claim 4 wherein the walls of the gaps close to the projectile are formed of a material different from material in walls of the gaps farther from the projectile.

6. The apparatus of claim 4 wherein the walls of the gaps close to the projectile have a lower melting temperature than walls of the gaps farther from the projectile.

7. The apparatus of claim 4 wherein the walls of the gaps close to the projectile have a smaller radius than walls of the gaps farther from the projectile.

8. The apparatus of claim 7 wherein the walls of the gaps close to the projectile are axially closer to each other than the walls of the gaps farther from the projectile.

9. The apparatus of claim 4 wherein the walls of the gaps close to the projectile are axially closer to each other than the walls of the gaps farther from the projectile.

10. The apparatus of claim 4 wherein each wall is part of a member having an outer periphery beyond the wall, the outer periphery being a cover for the portion of the member including the wall and being formed of a material that is eroded by the plasma at a rate which is much slower than the wall.

11. The apparatus of claim 10 wherein the cover material is an electric insulator.

12. The apparatus of claim 11 wherein the portion of the member including the wall is a metal.

13. The apparatus of claim 1 further including an electrical power supply connected to said structure for supplying sufficient electrical energy to said plasma so the plasma produces sufficient pressure to accelerate the projectile in the barrel, said power supply (i) initially producing a large pulse of electric power to initially apply a high pressure plasma to the projectile, (ii) then producing a smaller amount of electric power while pressure from the converted propellant is applied to the projectile, (iii) then producing an increasing amount of electric power so the pressure applied to the projectile remains approximately constant while the projectile is being accelerated in the barrel.

14. The apparatus of claim 1 wherein the discharges are established between metal portions of the structure.

15. The apparatus of claim 14 wherein the axial gaps are arranged so that when the plasma is initially produced the power applied to the plasma is substantially the same over the at least several discharges and results in sufficient pressure to accelerate the projectile away from an initial position thereof.

16. The apparatus of claim 14 wherein the axial gaps are arranged so that when the plasma is initially produced the power applied to the plasma is such that pressure waves in the propellant resulting from the plasma are not destructive of structural parts of the accelerating apparatus.

17. The apparatus of claim 14 wherein the gaps include walls that erode differently in response to the discharges so that the walls of the gaps close to the projectile erode faster than the walls of the gaps farther from the projectile.

18. Apparatus for supplying a high pressure pulse of gas along a longitudinal axis to an outlet port, comprising a structure for establishing at least several axial gaps for providing at least several axial electrical discharges behind the outlet port, the discharge causing plasma to flow with components at right angles to the axial discharges, a propellant mass positioned to be responsive to the plasma flow resulting from the discharges, the propellant mass being converted into a component of the high pressure gas pulse by the plasma flow, the gaps including walls that erode differently in response to the discharges so that the walls of the gaps close to the outlet erode faster than the walls of the gaps farther from the outlet.

19. The apparatus of claim 18 wherein the walls of the gaps close to the outlet are formed of a material different from material in walls of the gaps farther from the outlet.

20. The apparatus of claim 18 wherein the walls of the gaps close to the outlet have a lower melting temperature than walls of the gaps farther from the outlet.

21. The apparatus of claim 18 wherein the walls of the gaps close to the outlet have a smaller radius than walls of the gaps farther from the outlet.

22. The apparatus of claim 21 wherein the walls of the gaps close to the outlet are axially closer to each other than the walls of the gaps farther from the outlet.

23. The apparatus of claim 18 wherein the walls of the gaps close to the outlet are axially closer to each other than the walls of the gas farther from the outlet.

24. A cartridge to be loaded into a gun barrel comprising a projectile, a propelling structure for the projectile, the projectile and propelling structure being attached to each other, the propelling structure establishing at least several axial gaps for providing at least several axial electrical discharges behind the projectile, the discharges causing plasma to flow with components at right angles to the axial discharges for a substantial time while the projectile is traversing the barrel, a propellant mass positioned to be responsive to the plasma flow resulting from the discharges, the propellant mass being converted into a high pressure gas for accelerating the projectile in the barrel in response to the plasma resulting from the discharges being incident on the propellant mass, the axial gaps being arranged so that after the projectile moves away from its initial position and is in the barrel the power applied to the plasma via gaps close to the projectile is greater than the power applied to the plasma via the gaps farther from the projectile.

25. The cartridge of claim 24 wherein the gaps are arranged so that when the plasma is initially produced the power applied to the plasma is substantially the same over the at least several discharges and results in sufficient pressure to accelerate the projectile away from an initial position thereof.

26. A cartridge to be loaded into a gun barrel comprising a projectile, a propelling structure for the projectile, the projectile and propelling structure being attached to each other, the propelling structure establishing at least several axial gaps for providing at least several axial electrical discharges behind the projectile, the discharges causing plasma to flow with components at right angles to the axial discharges, a propellant mass positioned to be responsive to the plasma flow resulting from the discharges, the propellant mass being converted into a high pressure gas for accelerating the projectile in the barrel in response to the plasma resulting from the discharges being incident on the propellant mass, the gaps including walls that erode differently in response to the discharges so that the walls of the gaps close to the projectile erode faster than the walls of the gaps farther from the projectile.

27. The cartridge of claim 26 wherein the gaps are arranged so that when the plasma is initially produced the power applied to the plasma is substantially the same over the at least several discharges and results in sufficient pressure to accelerate the projectile away from an initial position thereof.

28. Apparatus for accelerating a projectile in a gun barrel comprising an electric discharge device including an electrode for establishing a high pressure plasma with sufficient energy to accelerate the projectile in the barrel, the high pressure plasma flowing via a flow path from the discharge device to the projectile to accelerate the projectile axially along the barrel, a confining structure for the plasma, the plasma having sufficient pressure so it tends to flow axially of the barrel out of the confining structure into contact with the electrode in a direction opposite from the direction of projectile acceleration in the barrel and thereby tends to establish an undesirable electrical connection between the electrode and another part of the discharge device, the confining structure including a chamber located axially behind the electric discharge device, a soft non-electrically conductive material in the chamber, the soft material expanding radially and being compressed axially against walls of the chamber to form a seal for overcoming the tendency of the plasma to flow out of the confining structure into contact with the electrode to prevent the undesirable electrical connection from being established.

29. The apparatus of claim 28 wherein the chamber has a first wall and a second axially extending wall to form a pocket, the first and second walls intersecting to form a closed end of the pocket, the pocket having an open end closer to the discharge device than the closed end, the soft material initially contacting the first and second walls and expanding radially against the first and second walls and compressing axially against the first all toward the closed end of the pocket.

30. The apparatus of claim 29 wherein the first wall is tapered radially inward in the direction of plasma flow away from the projectile.

31. Apparatus for accelerating a projectile in a gun barrel comprising an electric discharge device including an electrode for establishing a high pressure plasma with sufficient energy to accelerate the projectile in the barrel, the high pressure plasma flowing via a flow path from the discharge device to the projectile to accelerate the projectile axially along the barrel and thereby tends to establish an undesirable electrical connection between the electrode and another part of the discharge device, a confining structure for the plasma, the plasma having sufficient pressure so it tends to flow out of the confining structure into contact with the electrode via another flow path, the confining structure including a cavity located in the another flow path, a soft non-electrically conductive material in the cavity, the cavity and soft material being such that the soft material expands in a direction at right angles to the another flow path and compresses in the direction of the another flow path against walls of the cavity to form a seal for overcoming the tendency of the plasma to flow out of the confining structure into contact with the electrode to prevent the undesirable electrical connection from being established.

32. The apparatus of claim 31 wherein the electric discharge device comprises a structure for establishing at least several axial gaps for providing at least several axial electrical discharges behind the projectile, the discharges causing plasma to flow with components at right angles to the axial discharges for a substantial time while the projectile is traversing the barrel, a propellant mass positioned to be responsive to the plasma flow resulting from the discharges, the propellant mass being converted into a high pressure gas for accelerating the projectile in the barrel in response to the plasma resulting from the discharges being incident on the propellant mass, the axial gaps being arranged so that after the projectile moves away from its initial position and is in the barrel the power applied to the plasma via gaps close to the projectile is greater than the power applied to the plasma via the gaps farther from the projectile.

33. The apparatus of claim 32 where the confining structure is such that the plasma tends to flow axially of and away from the barrel.

34. The apparatus of claim 32 wherein the axial gaps are arranged so that when the plasma is initially produced the power applied to the plasma is substantially the same over the at least several discharges and results in sufficient pressure to accelerate the projectile away from an initial position thereof.

35. A cartridge to be loaded into a gun barrel comprising a projectile, a propelling structure for the projectile, the projectile and propelling structure being attached to each other, the propelling structure including an electric discharge device including an electrode for establishing a high pressure plasma with sufficient energy to accelerate the projectile in the barrel and thereby tends to establish an undesirable electrical connection between the electrode and another part of the discharge device, the high pressure plasma flowing via a flow path from the discharge device to the projectile to accelerate the projectile axially along the barrel, a confining structure for the plasma, the plasma having sufficient pressure so it tends to flow out of the confining structure into contact with the electrode via another flow path, the confining structure including a cavity located in the another flow path, a soft non-electrically conducting material in the cavity, the cavity and soft material being such that the soft material expands in a direction at right angles to the another flow path and compresses in the direction of the another flow path against walls of the cavity to form a seal for overcoming the tendency of the plasma to flow out of the confining structure into contact with the electrode to prevent the undesirable electrical connection from being established.

36. A source for deriving a high pressure gas pulse comprising a structure for establishing at least several axial gaps for providing at least several axial electrical discharges behind an outlet of the source, the discharge causing plasma to flow with components at right angles to the axial discharges for a substantial time while the pulse is being derived, a propellant mass positioned to be responsive to the plasma flow resulting from the discharges, the propellant mass being converted into a high pressure component of the gas pulse in response to the plasma resulting from the discharges being incident on the propellant mass, the axial gaps being arranged so that after the pulse is initially formed and is still being derived the power applied to the plasma via gaps close to the outlet is greater than the power applied to the plasma via the gaps farther from the outlet.

37. The apparatus of claim 36 wherein the axial gaps are arranged so that when the plasma is initially produced and the pulse is initially derived the power applied to the plasma is substantially the same in the at least several discharges.

38. A source for deriving a high pressure gas pulse at an outlet comprising an electric discharge device including an electrode for establishing a high pressure plasma component of the gas pulse, the high pressure plasma flowing via a flow path from the discharge device to the outlet and thereby tends to establish an undesirable electrical connection between the electrode and another part of the discharge device, a confining structure for the plasma, the plasma having sufficient pressure that it tends to flow axially of the flow path out of the confining structure into contact with the electrode in a direction opposite from the direction of the flow path to the outlet, the confining structure including a chamber located axially behind the electric discharge device relative to the outlet, a soft non-electrically conductive material in the chamber, the soft material expanding radially and being compressed axially against walls of the chamber to form a seal for overcoming the tendency of the plasma to flow out of the confining structure into contact with the electrode to prevent the undesirable electrical connection from being established.

39. The apparatus of claim 38 wherein the chamber has a first wall that is tapered radially inward in the direction of plasma flow away from the outlet, and a second axially extending wall, the first and second walls intersecting to form a pocket so the pocket has an open end closer to the discharge device than the intersection of the first and second walls, the soft material initially contacting the first and second walls and expanding radially against the first and second walls and compressing axially against the first wall.

40. Apparatus for accelerating a projectile in a gun barrel comprising an electric discharge device including an electrode for establishing a high pressure plasma with sufficient energy to accelerate the projectile in the barrel, the high pressure plasma flowing via a flow path from the discharge device to the projectile to accelerate the projectile axially along the barrel, a confining structure for the plasma, the plasma having sufficient pressure so it tends to flow relative to the barrel out of the confining structure into contact with the electrode to establish an undesirable electrical connection between the electrode and another part of the discharge device, the confining structure including means for preventing the undesirable electrical connection from being established.

41. A cartridge to be loaded into a gun barrel comprising a projectile, a propelling structure for the projectile, the projectile and propelling structure being attached to each other, the propelling structure including an electric discharge device including an electrode for establishing a high pressure plasma with sufficient energy to accelerate the projectile in the barrel and thereby tends to establish an undesirable electrical connection between the electrode and another part of the discharge device, the high pressure plasma flowing via a flow path from the discharge device to the projectile to accelerate the projectile axially along the barrel, a confining structure for the plasma, the plasma having sufficient pressure so it tends to flow out of the confining structure into contact with the electrode via another flow path, the confining structure including means located in the another flow path to form a seal for overcoming the tendency of the plasma to flow out of the confining structure into contact with the electrode to prevent the undesirable electrical connection from being established.

42. A source for deriving a high pressure gas pulse at an outlet comprising an electric discharge device including an electrode for establishing a high pressure plasma component of the gas pulse, the high pressure plasma flowing via a flow path from the discharge device to the outlet and thereby tends to establish an undesirable electrical connection between the electrode and another part of the discharge device, a confining structure for the plasma, the plasma having sufficient pressure that it tends to flow around the flow path out of the confining structure and into another flow path into contact with the electrode, the confining structure including means in the another flow path for forming a seal to overcome the tendency of the plasma to flow out of the confining structure into contact with the electrode to prevent the undesirable electrical connection from being established.

* * * * *

UNITED STATES PATENT AND TRADEMARK OFFICE

CERTIFICATE OF CORRECTION

PATENT NO.: 5,945,623

DATED: August 31, 1999

INVENTOR(S): Y.S.A. Goldstein

It is certified that an error appears in the above-identified patent and that said Letters Patent is hereby corrected as shown below:

Claim 23, col. 14, line 27, change "gas" to --gaps--;

Claim 29, col. 15, line 35, change "all" to --wall--.

Signed and Sealed this

Eighth Day of February, 2000

*Attest:*

Q. TODD DICKINSON

*Attesting Officer*

*Commissioner of Patents and Trademarks*